US006935938B1

(12) United States Patent
Gotkis et al.

(10) Patent No.: US 6,935,938 B1
(45) Date of Patent: Aug. 30, 2005

(54) MULTIPLE-CONDITIONING MEMBER DEVICE FOR CHEMICAL MECHANICAL PLANARIZATION CONDITIONING

(75) Inventors: Yehiel Gotkis, Fremont, CA (US); Robert Charatan, Portland, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/816,444

(22) Filed: Mar. 31, 2004

(51) Int. Cl.[7] ..... B24B 21/18
(52) U.S. Cl. ..... 451/443; 451/56
(58) Field of Search ..... 451/56, 443, 285, 451/287, 36

(56) References Cited

U.S. PATENT DOCUMENTS

| | | | | |
|---|---|---|---|---|
| 5,571,044 | A | 11/1996 | Bolandi et al. | |
| 5,803,799 | A | 9/1998 | Volodarsky et al. | |
| 5,913,714 | A | 6/1999 | Volodarsky et al. | |
| 6,083,082 | A | 7/2000 | Saldana | |
| 6,086,460 | A | 7/2000 | Labunsky et al. | |
| 6,116,997 | A * | 9/2000 | Hakomori et al. | 451/444 |
| 6,261,168 | B1 | 7/2001 | Jensen et al. | |
| 6,315,634 | B1 | 11/2001 | Jensen et al. | |
| 6,361,411 | B1 * | 3/2002 | Chopra et al. | 451/56 |
| 6,361,414 | B1 | 3/2002 | Ravkin et al. | |
| 6,371,838 | B1 * | 4/2002 | Holzapfel | 451/72 |
| 6,390,902 | B1 * | 5/2002 | Chang et al. | 451/285 |
| 6,447,374 | B1 * | 9/2002 | Sommer et al. | 451/56 |
| 6,607,427 | B2 * | 8/2003 | Togawa et al. | 451/56 |
| 6,626,743 | B1 | 9/2003 | Boyd | |
| 6,645,046 | B1 | 11/2003 | Vogtmann et al. | |
| 6,645,052 | B2 * | 11/2003 | Jensen et al. | 451/41 |
| 6,746,313 | B1 | 6/2004 | Pham et al. | |
| 6,746,320 | B2 | 6/2004 | Krusell et al. | |
| 6,752,698 | B1 | 6/2004 | Renteln et al. | |
| 6,755,723 | B1 | 6/2004 | Pham | |
| 6,767,427 | B2 | 7/2004 | Walters et al. | |

* cited by examiner

*Primary Examiner*—Eileen P. Morgan
(74) *Attorney, Agent, or Firm*—Brinks Hofer Gilson & Lione

(57) ABSTRACT

A multiple-conditioning member device for chemical mechanical planarization conditioning is described. The multiple conditioning members may be used in a chemical mechanical planarization apparatus which further includes a movably mounted polishing member, a wafer holder, and a slurry dispenser. The multiple conditioning members may be independently movable with respect to one another and configured to contact the polishing member. Specifically, a conditioning member may be independently movable with respect to another conditioning member based on x-axis control, y-axis control, z-axis control, alignment, speed of rotation, direction of rotation, amount of pressure of conditioning member on polishing member.

17 Claims, 6 Drawing Sheets

MULTIPLE-CONDITIONING MEMBER DEVICE FOR CHEMICAL MECHANICAL PLANARIZATION CONDITIONING

FIELD OF THE INVENTION

The present invention relates to a method and apparatus for conditioning a polishing member. More particularly, the present invention relates to a method and system for conditioning a polishing member used in the chemical mechanical planarization of semiconductor wafers using a multiple-conditioning member device.

BACKGROUND

Semiconductor wafers are typically fabricated with multiple copies of a desired integrated circuit design that will later be separated and made into individual chips. A common technique for forming the circuitry on a semiconductor is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive toward smaller, more highly integrated circuit designs. Semiconductor wafers are also commonly constructed in layers, where a portion of a circuit is created on a first level and conductive vias are made to connect up to the next level of the circuit. After each layer of the circuit is etched on the wafer, a dielectric layer is put down allowing the vias to pass through but covering the rest of the previous circuit level. Each layer of the circuit can create or add unevenness to the wafer that is preferably smoothed out before generating the next circuit layer.

Chemical mechanical planarization (CMP) techniques are used to planarize the raw wafer and each layer of material added thereafter, as well as to remove excessive (overburden) materials deposited over the wafer surface during metal deposition operations and in this way to shape the device interconnect features. Available CMP systems, commonly called wafer polishers, often use a rotating wafer holder that brings the wafer into contact with a polishing pad moving in the plane of the wafer surface to be planarized. A polishing fluid, such as a chemical polishing agent or slurry containing microabrasives, is applied to the polishing pad to polish the wafer. The wafer holder then presses the wafer against the rotating polishing pad and is rotated to polish and planarize the wafer. Material is thereby removed as a result of the mutual wafer/polishing pad interaction.

With use, the polishing pad becomes eroded and changes its surface properties during the wafer processing. For example, the material removal results in: accumulation of by-products and debris in the pad's pores and grooves; absorption of chemicals by pad material and pad staining; pore glazing due to pad material heating; and direct erosion of the pad material.

The pad surface is continuously changing its properties during a process run, which affects the local CMP response and causes numerous process non-uniformity, instability, planarization, and defectivity issues. Variation in the pad properties during the process run is a significant CMP problem. The variation of the pad properties in general is uneven, affecting the CMP response. Pad porosity is considered to be an important parameter enabling reasonable removal rates. Pores in the polishing pad transfer slurry underneath the wafer and carry away the process by-products. Blocking the pad pores with non-elastic process by-products affects both transport and mechanical properties of the pad, which negatively effects the process performance parameters.

Therefore, pad surface regeneration is a important supporting sub-task in CMP. Pad conditioning, including dressing/cleaning, is introduced to revive the pad surface. Normally, a continuous, in situ, or a periodic, ex situ, abrasive treatment, is applied to the pad surface along with some chemical action, such as DI water dissolution in a simple case. This treatment cleans out the existing pores, creates new pores, and removes process by-products and the thin upper glazed pad layer. The more material removed by and deposited over a unit of pad surface, the more aggressive the pad conditioning action.

Unfortunately, along with positive pad surface activity regeneration, conditioning action may have negative effects upon the CMP performance. Those effects include planarization efficiency which is affected by scratching the pad surface and defectivity and surface contamination. Since pad surface conditioning is an important supporting function in CMP, milder balanced conditioning is warranted for a healthy CMP process. This is particularly true if low porosity or non-porous pads are used in the CMP process.

The existing conditioning device configuration consists primarily of one controllably loaded rotation diamond disc, which reactivates the pad surface by scraping and micro-scratching the pad surface. Typically, the conditioning disc lifetime is reasonably short, requiring frequent changes of the conditioning disc. This results in time losses and tool re-qualification, normally associated with numerous quality problems. Accordingly, further development of an apparatus and method for mildly conditioning the surface of the polishing pad used in the chemical mechanical planarization process is desired.

SUMMARY

In one aspect of the invention, a chemical mechanical planarization system is provided. The system may include a movably mounted polishing member, such as a cycling polishing belt or a rotating polishing disc. The system may further include a wafer holder for holding a wafer relative to the polishing member, a slurry dispenser for dispensing slurry onto the polishing member, and a conditioner. The conditioner may include at least two conditioning members, with the two conditioning members being independently movable with respect to one another and configured to contact the polishing member. For example, a conditioning member may be independently movable with respect to another conditioning member in the conditioning mechanism based on x-axis control, y-axis control, z-axis control, alignment, speed of rotation, direction of rotation, and/or amount of pressure of conditioning member on polishing member. Multiple conditioning members enable better polishing of the polishing member than a single conditioning member with an equivalent contact surface area. Due to irregularities in the polishing member, the single conditioning member may not condition the polishing member as well as the multiple conditioning members. Moreover, using multiple conditioning members may extend the life of the conditioning members. Further, using multiple conditioning members may provide more uniform pressure to the polishing member.

DETAILED DESCRIPTION OF THE PRESENTLY PREFERRED EMBODIMENTS

Figure 1:
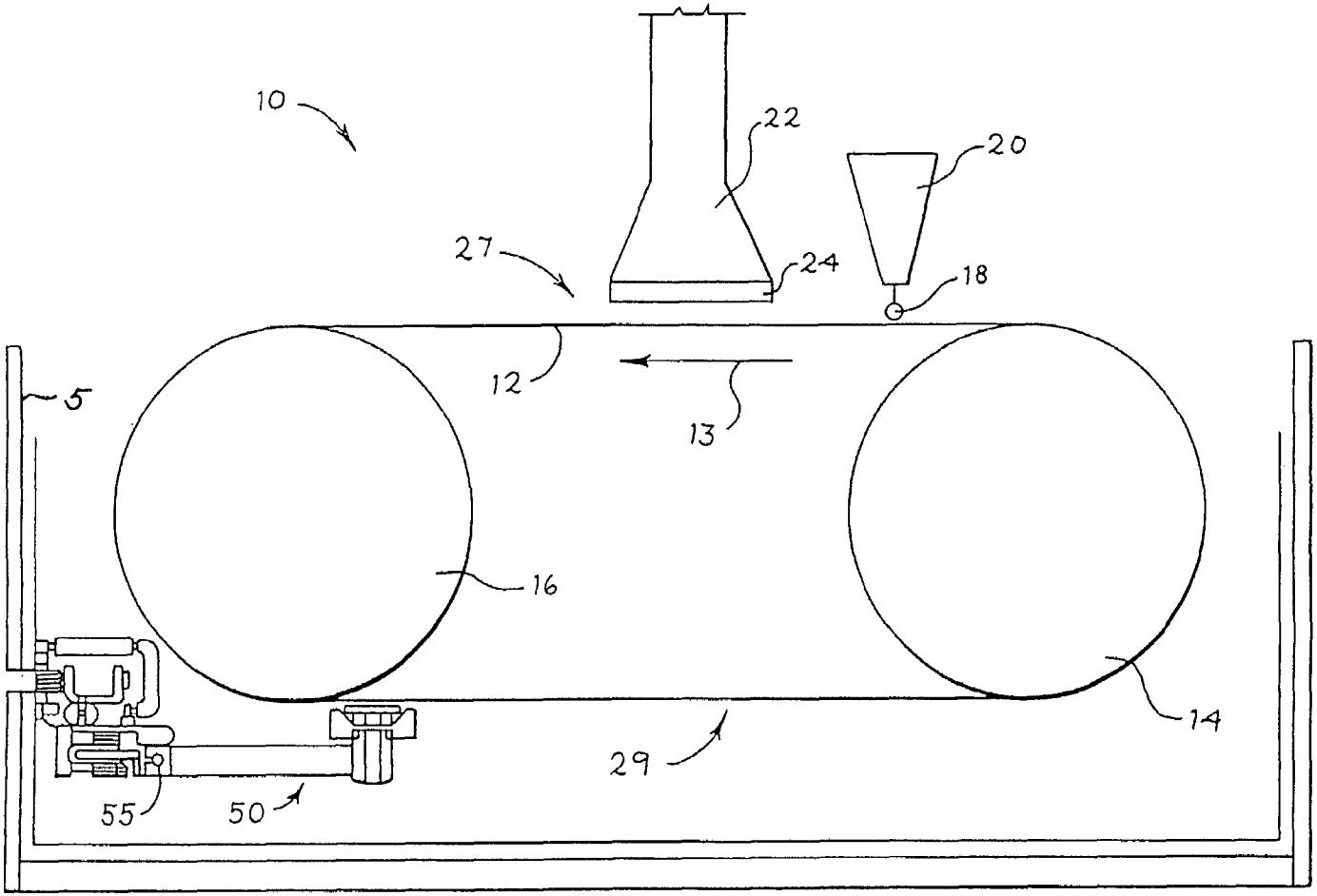
FIG. 1 shows a side view of a chemical mechanical polishing apparatus for semiconductor wafers.

In order to address the deficiencies of the prior art, a method and apparatus is described below for a conditioner having a plurality of conditioning members for a chemical mechanical planarization process. In the drawings where like reference numerals refer to like elements, FIG. 1 shows a side view of a system according to an embodiment of the present invention. Although a CMP system incorporating a linear apparatus is shown in FIG. 1, rotary apparatuses, orbital apparatuses, or any CMP techniques utilizing a rigidly shaped conditioning member are also contemplated.

FIG. 1 shows linear polishing apparatus 10. An example of a linear polishing apparatus is the TERES wafer polisher available from Lam Research Corporation of Fremont, Calif. A conditioning mechanism 50 may be used in combination with the linear polishing apparatus 10. In one embodiment, the linear polishing apparatus 10 polishes away materials on the surface of a semiconductor wafer 24. The removed material can be the substrate material of the wafer itself or one of the layers formed on the substrate. Such formed layers include dielectric materials (such as silicon dioxide or silicon nitride), metals (such as aluminum, copper, or tungsten), metal alloys or semiconductor materials (such as silicon or polysilicon). More specifically, the linear polishing apparatus 10 may use CMP to polish or remove one or more of these layers fabricated on the wafer 24 to planarize the surface layer.

In one embodiment, the polishing member 12 of the linear polishing apparatus 10 comprises a pad mounted to a belt. The combination of pad and belt is one example of a polishing member 12. The polishing member moves linearly with respect to the surface of wafer 24. Other types of linear polishing members, such as integrated pad/belt combinations, or pads already initially shaped as belts are also suitable. Alternatively, rotary polishing members may be used when a rotary apparatus is used.

The polishing member 12 is a continuous polishing member cycling or revolving about rollers 14 and 16. A driving means, such as an electric motor, applies a rotational motion that causes polishing member 12 to move in a linear motion with respect to the wafer 24 as shown by direction arrow 13. A portion of polishing member 12 moving from roller 14 to roller 16 is in the top region 27, where polishing of wafer 24 occurs. As shown in FIG. 1, the portion of the polishing member 12 moving from roller 16 to roller 14 is the bottom region 29, where conditioning of polishing member 12 occurs using conditioning mechanism 50. Alternatively, conditioning may occur at any other portion of the polishing member 12. For example, the conditioning mechanism may be positioned such that the portion of the polishing member 12 moving from roller 14 to roller 16 in the top region 27 is where conditioning of polishing member 12 occurs.

Each roller typically comprises a stainless steel cylinder, which generally comprises a diameter of around 12 inches. Although the present invention uses stainless steel for the rollers, other materials are suitable as well including a stainless steel covered metal. And, although the present invention generally uses a roller with a diameter of around 12 inches, other diameters for the rollers are suitable as well. Additionally, both rollers further comprise roller pads, with each roller pad being approximately 0.5" of rubber, although other materials and thicknesses are suitable for use as well. The length of rollers 14 and 16 (with their respective roller pads) are generally the same as the width of the polishing member 12, which is typically 12 inches to 14 inches.

The wafer 24 may be held by wafer carrier 22. For example, the wafer 24 may be held in position by a mechanical retaining means (such as a retainer ring) and/or by a vacuum in the wafer carrier 22. The wafer carrier 22 may position the wafer atop polishing member 12 so that the surface of the wafer contacts the pad portion of polishing member 12. The wafer carrier 22 may rotate the wafer 24 and apply an adjustable downforce to the wafer against the polishing member 12. The rotation of the wafer 24 provides circular averaging of the wafer/pad contact parameters.

The linear polishing apparatus 10 additionally contains a slurry dispensing mechanism 20, which dispenses slurry 18 onto polishing member 12. The slurry 18 may be a mixture of de-ionized water, fine abrasive species and chemicals, mixed to chemically aid the smooth and predictable planarization of the wafer front surface topography. Any of a number of commercially available slurries may be used. A slurry dispensing mechanism 20 dispenses the slurry 18 onto polishing member 12 before a semiconductor wafer 24 supported in wafer carrier 22 is polished. When the wafer 24 is polished, the used and sometimes agglomerated and otherwise hardened slurry 18 slides off roller 16, and polishing member 12 is conditioned using conditioning mechanism 50. The roughness capillarity of the polishing member may help transfer/distribute slurry to points of the contact surface and take away process by-products formed as a result of material removal sequence with the wafer.

Figure 2:
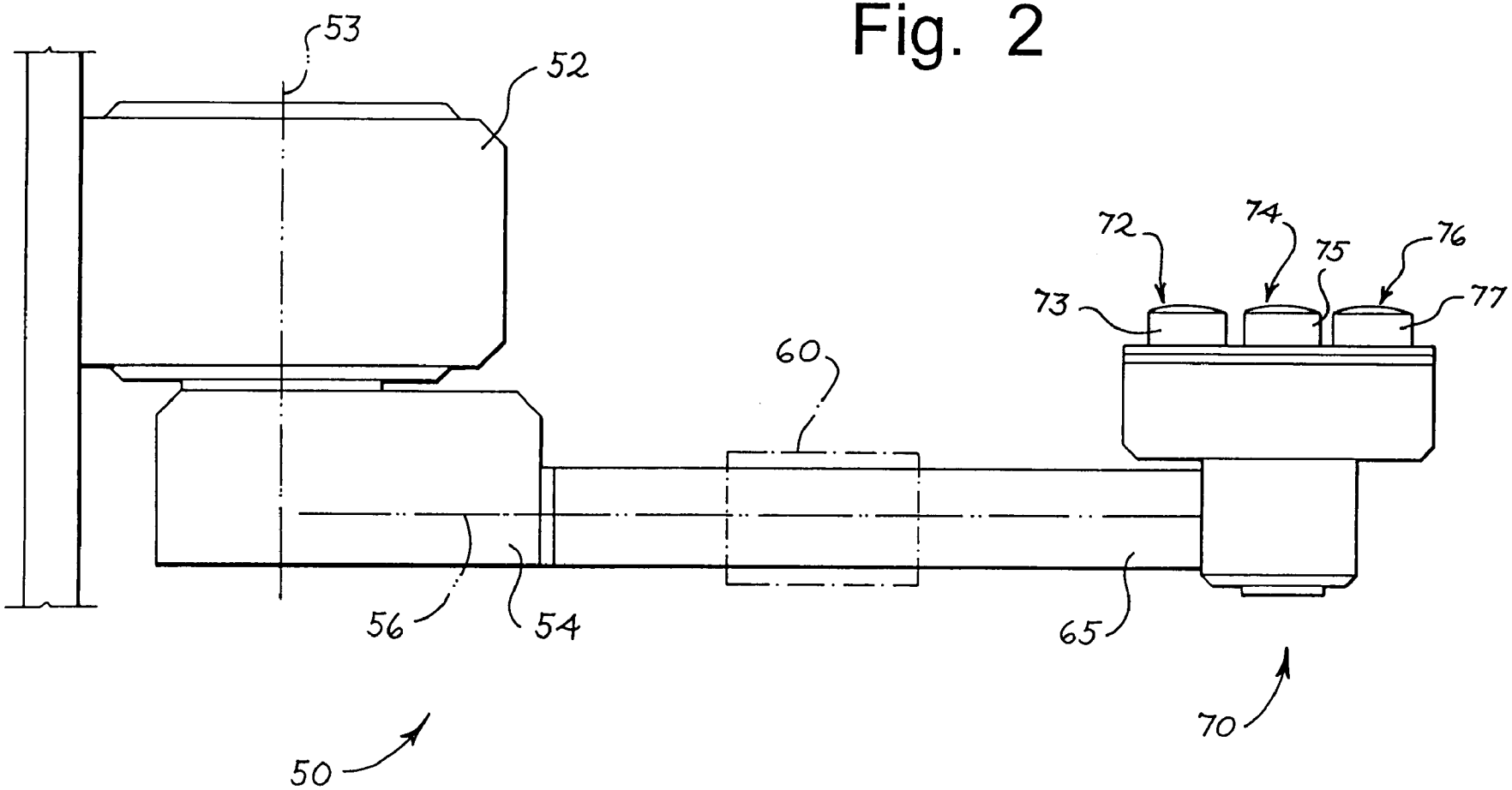
FIG. 2 shows a side view of an exemplary conditioning mechanism with multiple heads on a single end effector that may be used on the chemical mechanical polishing apparatus of FIG. 1.

Referring to FIG. 2, there is shown a side view of an exemplary conditioning mechanism with multiple heads on a single end effector that can be used on the chemical mechanical polishing apparatus of FIG. 1. Generally, conditioning mechanism 50 comprises a drive mechanism having sweeping driver 52, vertical driver 54, an arm 65, and an end effector 70. End effector 70 at one side has a plurality of conditioning members 72, 74, 76. Three conditioning members 72, 74, 76 are shown in FIG. 2. More or fewer conditioning members may be placed in end effector 70. Alternatively, multiple end effectors 70 may be placed on arm 65, with a single or multiple conditioning members on each end effector 70. Conditioning members 72, 74, 76 may have a surface which concurrently contacts polishing member 12 with an abrasive element integral with the contact surface or attached to the contact surface (such as diamond particles bonded to the contact surface). An example of a conditioning member is a conditioning disc which has a contact surface that is part of main body 73, 75, 77 of conditioning members 72, 74, 76.

In one aspect of the invention, a conditioning member may be independently movable with respect to at least one other conditioning member. For example, a conditioning member may be independently movable with respect to another conditioning member in the conditioning mechanism 50 based on x-axis control, y-axis control, z-axis control, alignment, speed of rotation, direction of rotation, amount of pressure of conditioning member on polishing member (such as downforce). These parameters relating to independent motion control act as operation control parameters for the conditioning members of the conditioning mechanism 50.

The independent alignment, for example, may be accomplished via gimbaling, described below. One, some or all of the conditioning members in the conditioning mechanism 50 may be self-aligned using a gimbaling mechanism, with a disc of the conditioning member in effect floating in a non-rigid orientation of the conditioning disc plane. The gimbaling mechanisms on the conditioning members may allow the conditioning members to concurrently contact the polishing element. Similarly, the conditioning members may be independently controllable in the x-, y-, and/or z-axis. Specifically, the independent control may be automatic, such as via a spring, or may be manually controllable. As another example, the speed of rotation for the conditioning members may be the same. This may be accomplished by using a single motor to rotate each of the conditioning members. Alternatively, the speed of rotation for the conditioning members may be different. This may be accomplished by using a single motor with gearing to effect the different speeds or may be accomplished by using multiple motors, with each motor assigned to a conditioning member. As still another example, the rotation for the conditioning member may be in the same direction. Alternatively, the rotation for a pair of conditioning members may be in different directions, with a disc of one conditioning member rotating clockwise and a disc of a second conditioning member rotating counter-clockwise. Further, the amount of force applied to contact the conditioning member and the polishing member may be different for conditioning members in the conditioning mechanism. Specifically, the downforce used to press the contact surface of one conditioning member with the polishing member may be different from the downforce used to press the contact surface of a second conditioning member with the polishing member. Alternatively, the amount of pressure for the conditioning members may be configured to be the same or substantially similar for the conditioning members. In this manner, the conditioning members may provide a uniform pressure, or substantially uniform pressure, to the polishing member.

Previous conditioning device configurations consisted of a single controllably loaded conditioning member, such as a rotating diamond disc. As discussed in the background section, prior configurations suffer from frequent replacement of the diamond disc. Replacing a smaller diamond disc with a larger diamond disc may reduce the replacement frequency, but creates several new problems. The larger diamond disc creates a larger surface contact area with the polishing member. Because the polishing member may not be perfectly flat, this may result in the conditioning member conditioning the polishing member unevenly. In addition, the pressure over the entire surface area of the large surface contact area may not be uniform. This is in contrast to the multiple conditioning members which may provide uniform or substantially uniform pressure to the polishing member. Moreover, for a rotating disc, the larger disc creates a greater variation in the linear speeds from the center of the disc to the edges of the disc. For example, a disc which doubles its radius will similarly double the speed at the edge of the disc. This increase in the speed may be undesirable. By contrast, utilizing multiple conditioning members may extend the life of individual conditioning members. Moreover, since the multiple conditioning members are independently controllable, better control may be achieved than if a single larger diamond disc is utilized.

As shown in FIG. 2, conditioning members 72, 74, 76 comprise a main body 73, 75, 77 with a contact surface oriented to contact a polishing pad. The contact surface with the polishing member is pre-shaped, such as a curved shape, based on the expected deformation of the polishing member during operation of the CMP apparatus. The curved contact surface of conditioning members 72, 74, 76 may thus conform to deformation of a portion of the polishing member of the CMP system during conditioning of the polishing member.

The curved contact surface may enable better conditioning of the polishing disk and/or more even wear of the conditioning member. The curved contact surface is disclosed in co-pending application entitled Conditioning Member For A Chemical Mechanical Planarization Process, filed on Mar. 31, 2004, Ser. No. 10/816,442, which is hereby incorporated herein in its entirety.

Sweeping driver 52 is attached to a frame 5 using any attachment means or mechanism known in the art. Sweeping driver 52 can be attached to the frame 5 using pins, bolts, screws, and the like. Sweeping driver 52 can be attached to the frame 5 using adhesives. Sweeping driver 52 can be attached through welding, molding and other like techniques.

Sweeping driver 52 is configured to sweep end effector 70 and the conditioning member associated with end effector 70 across polishing member 12. Sweeping driver 52 can sweep the end effector 70 and the conditioning member in an arc across polishing member using one end of the arm 65 as a pivot. Alternatively, sweeping driver can move end effector 70 and the conditioning member linearly across polishing member.

Sweeping driver 52 may produce the sweeping motion of arm 65 through hydraulics, pneumatics, mechanical means, electrical means, electro-mechanical means, or a fuel-burning motor. Preferably, sweeping driver 52 is powered by a motor/reducer assembly. A suitable assembly is commercially available through companies such as Animatics, located in Santa Clara, Calif.

Vertical driver 54 is attached to sweeping driver 52 using any attachment means or mechanism known in the art. Vertical driver 54 can be attached to sweeping driver 52 using pins, bolts, screws, and the like. Vertical driver 54 can be attached to sweeping driver 52 using adhesives. Vertical driver 54 can be attached to sweeping driver 52 through welding, molding and other like techniques.

Vertical driver 54 moves arm 65 up and down about pivot point 55. Vertical driver 54 is selectively operable to raise the end effector 70 and the conditioning member therein in contact with polishing member 12 for conditioning. When conditioning is stopped, vertical driver 54 also lowers the end effector 70 and conditioning member out of contact with polishing member 12.

Vertical driver 54 causes the up and down motion of arm 65 through hydraulics, pneumatics, mechanical means, electrical means, electro-mechanical means, or a fuel-burning motor. Preferably, vertical driver 54 is powered by a bellow style pneumatic actuator. A suitable vertical driver 54 is commercially available through companies such as Festo, Inc. located in Hauppauge, N.Y.

Arm 65 is attached to both the end effector 70 and the drive assembly. Arm 65 can be attached to the end effector 70 using pins, bolts, screws, and the like. Arm 65 can be attached to the end effector 70 using adhesives. Arm 65 can be attached to the end effector 70 through welding, molding and other like techniques.

Figure 3A:
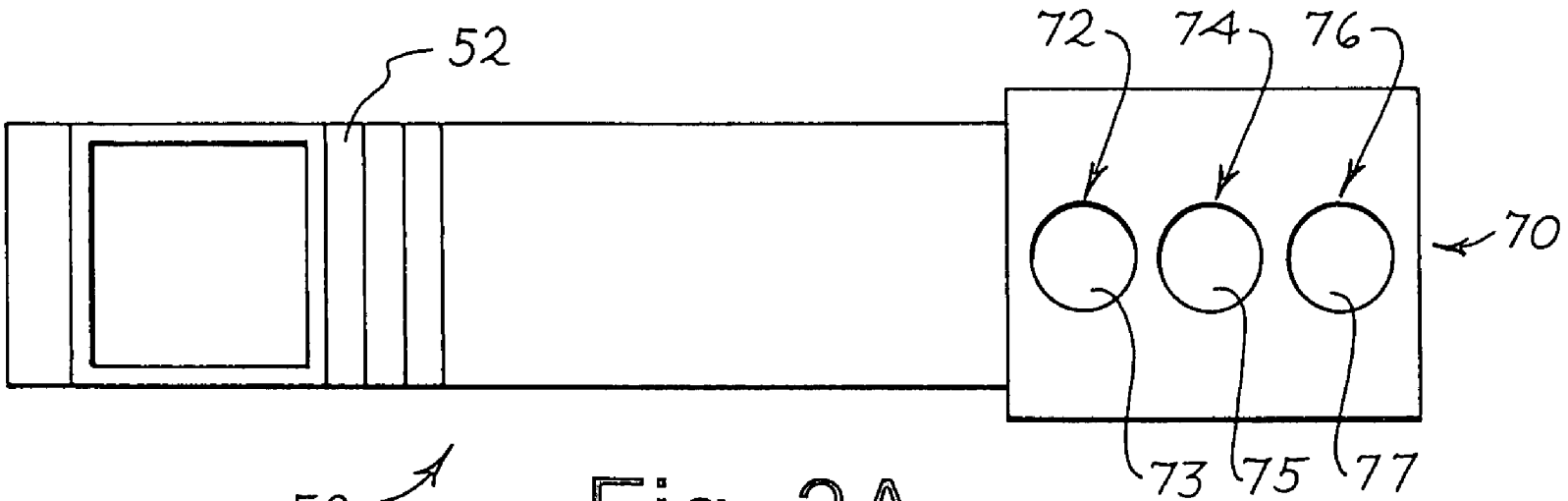
FIG. 3*a* is a top view of the exemplary conditioning mechanism depicted in FIG. 2.
Figure 3B:
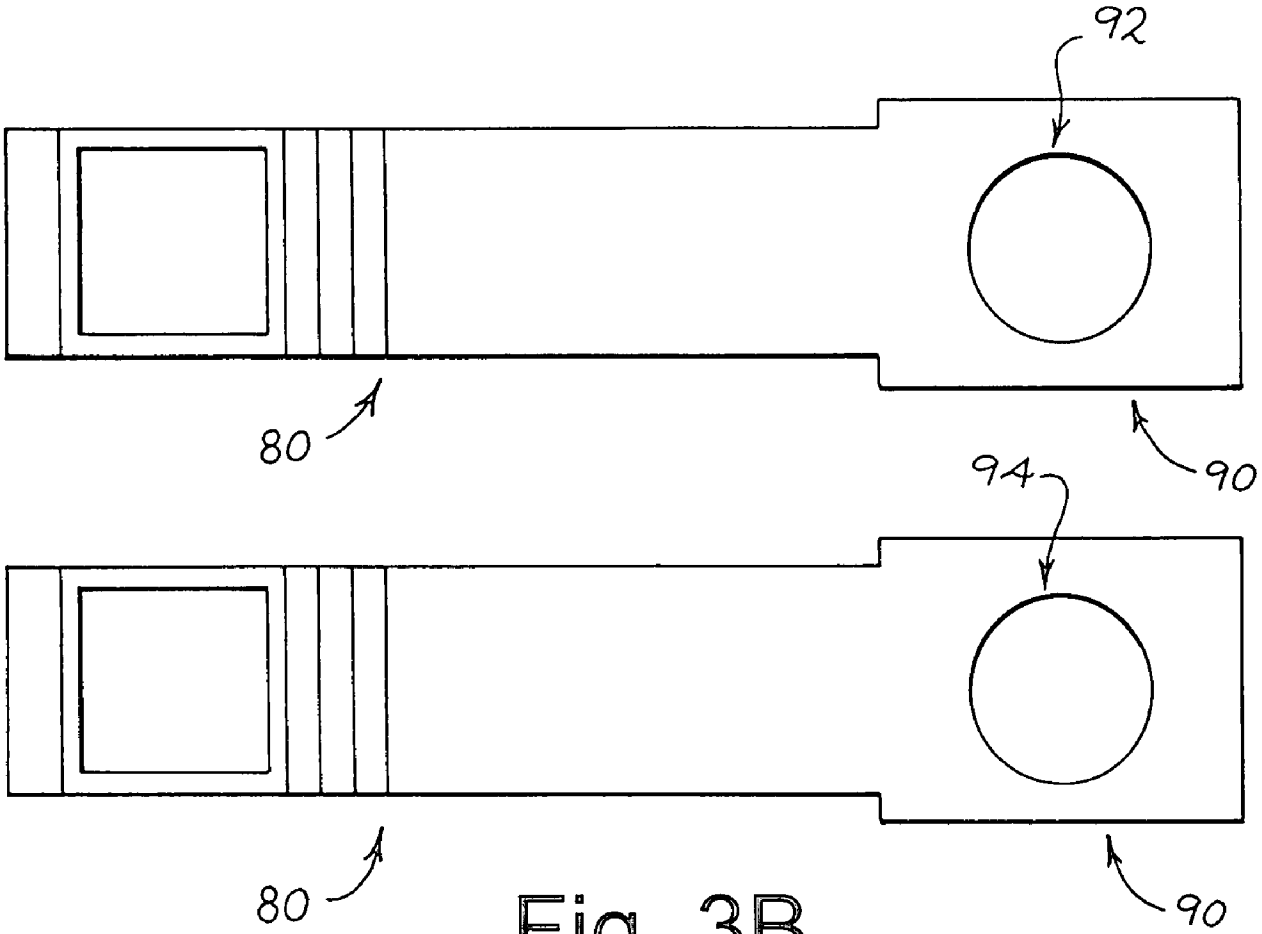
FIG. 3*b* is a top view of multiple conditioning mechanisms.

Referring to FIG. 3*a*, there is shown a top view of the exemplary conditioning mechanism depicted in FIG. 2. The multiple conditioning members may be configured in a variety of ways. As shown in FIGS. 2 and 3*a*, the conditioning members 72, 74, 78 are in a column. Alternatively, the conditioning members may be in a row (see FIG. 3*b*), in a triangle, square, or any other arrangement for the plurality of conditioning members. For example, FIG. 3*b* shows a top view of multiple conditioning members 92, 94, each mounted on a conditioning mechanism 80. The conditioning mechanisms 80 in FIG. 3*b* are similar to the single conditioning mechanism 50 disclosed in FIGS. 2 and 3*a*. The conditioning mechanisms include sweeping driver 52 and arm 65. In addition, the conditioning mechanisms 80 include end effectors 90. Alternatively, an end effector may include more than one conditioning member.

As shown in FIG. 3*b*, each end effector 90 includes conditioning members 92, 94, which may comprise a conditioning disc. Conditioning member 92 may be independently positioned with respect to conditioning member 94. For example, due to the separate sweeping drivers 52 and arms 65, the conditioning members may be independently positioned in an x-, y-, or z-orientation. Moreover, each conditioning mechanism 80 may include a motor or other means for rotating the conditioning members 92, 94 so that the rotational speed of the conditioning members 92, 94 may be controlled or adjusted independently.

Figure 4:
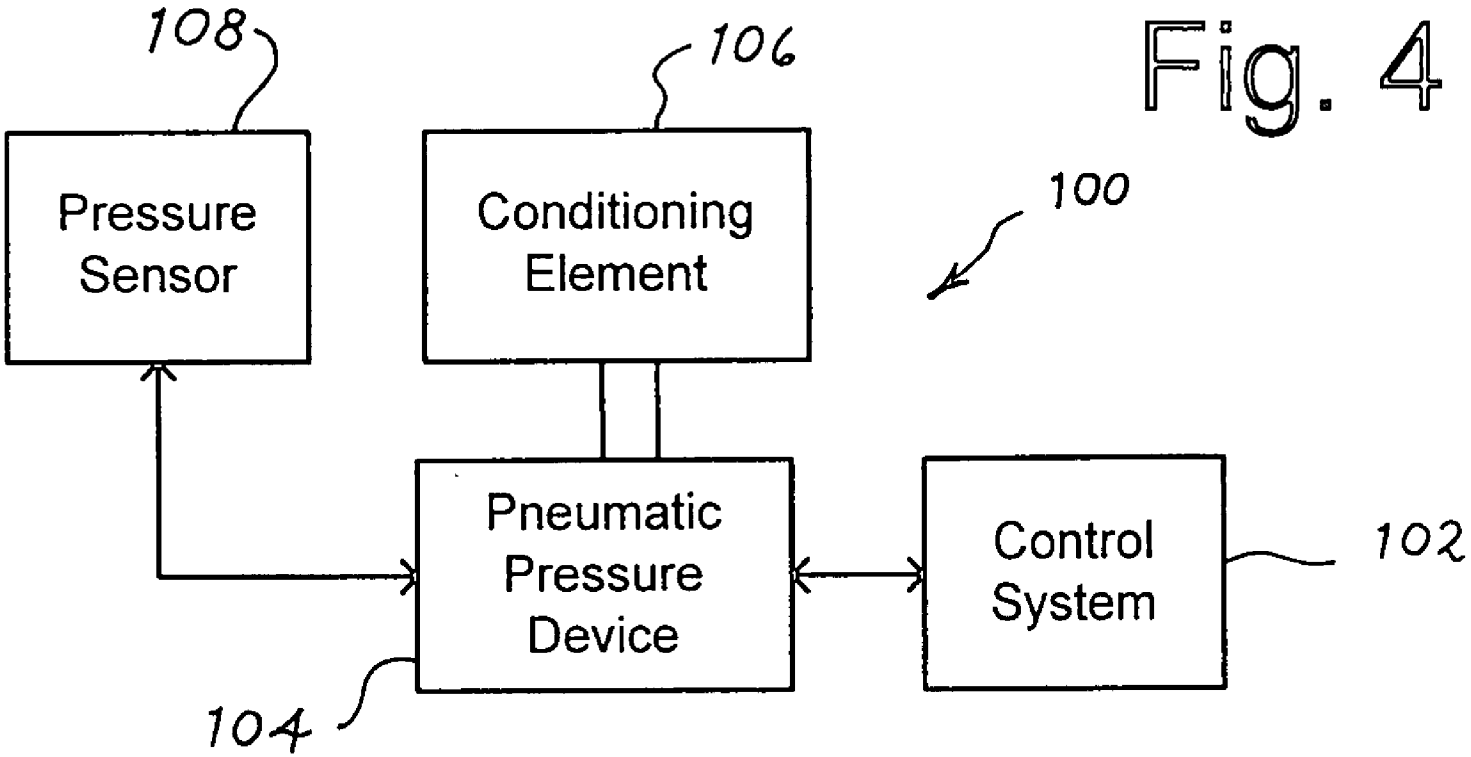
FIG. 4 is a block diagram depicting the z-axis control for the conditioning member.

As discussed above, several operation control parameters may be controlled independently for the conditioning members. For example, the z-axis positioning of a pair of conditioning members may be controlled independently of one another. A block diagram 100 depicting the z-axis control for a single conditioning member is shown in FIG. 4. The z-axis control may be dictated by control system 102. Control system 102 may comprise a processor in combination with a memory, a microcontroller, or any other arithmetic, logic and/or control device. The control system 102 may command a pneumatic pressure device 104 to move the conditioning member 106 in the z-axis direction until a predetermined pressure is achieved. The pneumatic pressure device 104 may achieve the commanded predetermined pressure using feedback from pressure sensor 108. Specifically, pressure sensor 108 may transmit to the pneumatic pressure device 104 the pressure the contact surface of the conditioning member sees. The pneumatic pressure device 104 may control the amount of air based on the pressure reading from pressure sensor 108. The control system 102 may command that the pressure exerted on each of the conditioning members contacting the polishing member is equal so that the pressure from each conditioning member is uniform or substantially uniform. Thus, the pneumatic pressure device 104 may adjust its operation for each of the conditioning elements such that the pressure as indicated by each pressure sensor 108 associated with a conditioning member 106 equals the pressure indicated by the control system 102. Alternatively, the control system 102 may command that the pressure exerted on each of the conditioning members contacting the polishing member is different so that the pressure from each conditioning member is not uniform. Each of the conditioning members may include the hardware shown in FIG. 4, so that each of the conditioning members may be independently controlled in the z-axis. Alternatively, independent control may also be achieved using a common control system and pneumatic pressure device for all of the conditioning members, with each conditioning member having associated with it an individual pressure sensor to provide feedback.

In another embodiment, the z-axis control for the multiple conditioning members individually controlled using springs. For example, a single spring may be connected to each conditioning member, thereby independently controlling the z-axis for each conditioning member. If it is desired to have uniform pressure by each of the conditioning members, springs with identical or similar qualities may be installed for each of the conditioning members so that the pressure on the polishing member is uniform or substantially uniform.

Figure 5:
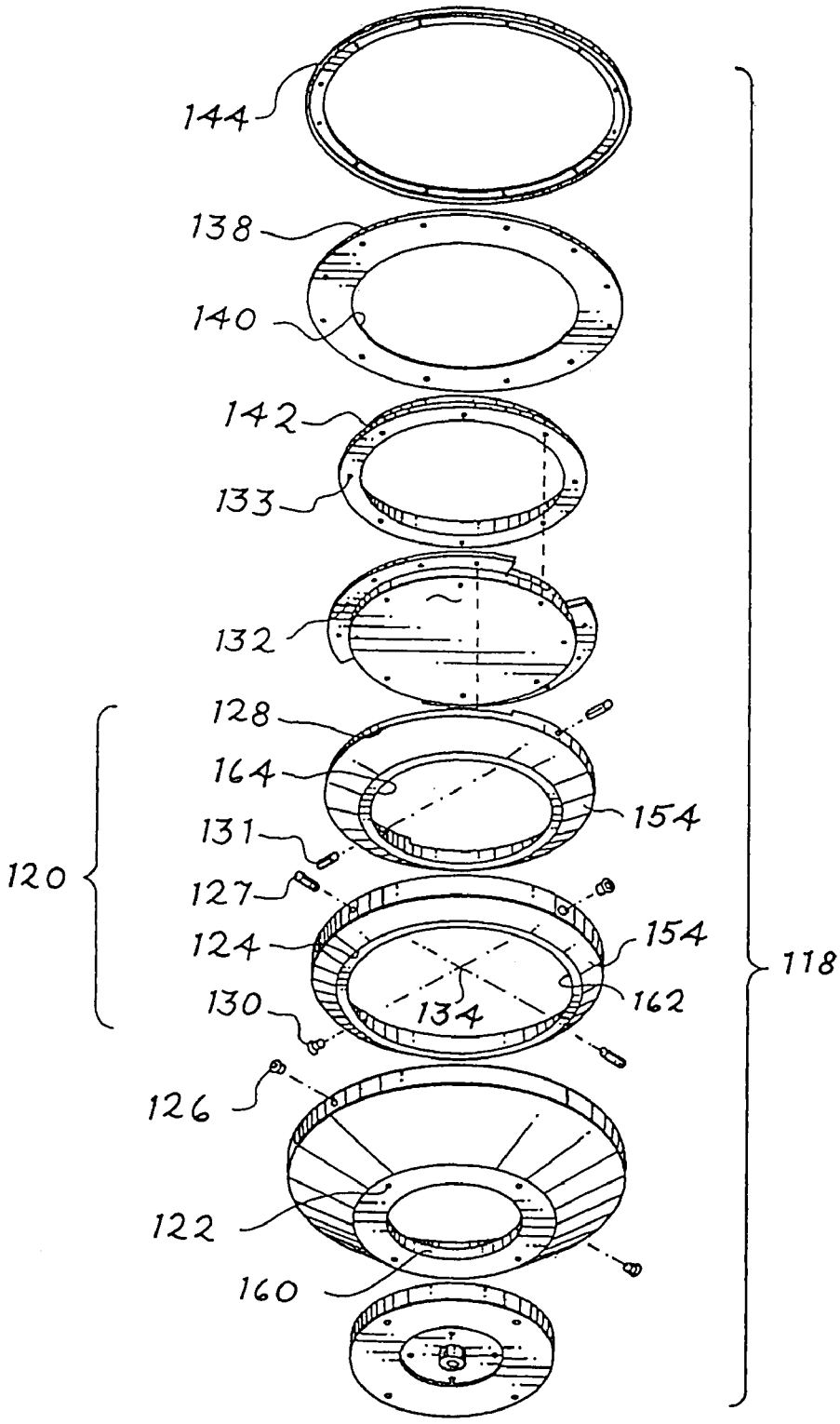
FIG. 5 is an exploded view for an exemplary conditioning member holder.

Moreover, as discussed above, the alignment of a pair of conditioning members may be controlled independently of one another. The independent control may be performed in a variety of manners. One example is shown in FIG. 5 which discloses gimbaling mechanism for a single a conditioning member. Each conditioning member may include the gimbaling mechanism, thus enabling independent control.

FIG. 5 shows an exploded view for an exemplary conditioning member holder. The conditioning member holder 118 includes a cardan joint 120 supported in an outer housing 122. The cardan joint 120 includes an outer ring 124 that is mounted for rotation with respect to the housing 122 by two first bearings 126 and first shafts 127 that are aligned with the x-axis in this embodiment. An inner ring 128 is mounted for rotation with respect to the outer ring 124 by two second bearings 130 and second shafts 131 that are aligned with the Y axis in this embodiment. The x- and y-axes meet at a central position in the conditioning member holder 118 and define a center of rotation 134. A conditioning member chuck 132 is supported only around its periphery by the inner ring 128. This area of support extends away from the perimeter of the chuck 132 by no more than about 10% of the diameter of the chuck 132. The conditioning member chuck 132 can be formed in any suitable manner so as to hold the conditioning member in place on the chuck 132 during conditioning. The exposed surface of the conditioning member that is positioned adjacent the polishing member belt defines a conditioning plane.

The cardan joint 120 is provided with an annular elastomeric seal 138. The inner periphery 140 of the seal 138 fits within a peripheral groove 142 of the guide ring 133 and is retained therein. The outer periphery of the seal 138 is releasably secured to the housing 122 by a clamp ring 144 that is held in place, for example by nylon screws. The seal 138 prevents the slurry used in the chemical mechanical conditioning operation from entering the interior of the cardan joint 120. The seal 138 has sufficient flexibility to allow the outer and inner rings 124, 128 to rotate.

Additionally, the first bearings 126 are sealed against the slurry by elastomeric disks 148. Each of the elastomeric disks 148 defines an annular flange 150 which fits within a mating recess 152 in the housing 122. The disks 148 seal the first bearings 126 against contamination by the polishing slurry.

The interior of the housing 122, the inner and outer surfaces of the outer ring 124, and the outer surface of the inner ring 128 form nested frusto-conical surfaces 154 that act as stops to define the maximum permitted angle of rotation about the X and Y axes. A predetermined range of maximum tilting of the outer ring 124 with respect to the housing 122 may be selected. For example, selected ranges may include ±1.2°, and a maximum tilt angle of the inner ring 28 with respect to the outer ring 124 of ±1.2°.

Additionally, the inner ring 128 supports the conditioning member chuck 132 about its peripheral surface. This even support for the conditioning member chuck 132 reduces distortion of the conditioning member chuck 132 during the conditioning operation, and it stresses a peripheral portion of the chuck 132 to a greater extent than a central portion.

The conditioning member chuck 132 defines a rear surface 156, opposite the conditioning member. The housing defines a central opening 160 and the outer and inner rings 124, 128 define respective central openings 162 and 164. The central openings 160, 162, 164 allow unobstructed access to the rear surface 156 of the conditioning member chuck 32. This arrangement allows convenient mounting and servicing of systems for the conditioning member.

The stops formed by the frusto-conical surfaces 154 may maintain the cardan joint 120 in a substantially centered relationship, even when the conditioning member is not in contact with the polishing belt. The cardan joint 120 gimbles to allow the conditioning plane of the conditioning member to orient itself parallel to the polishing member, whether on a belt or a rotating table. The cardan joint allows for near-perfect alignment between these two surfaces. The shape of the housing, inner ring, and outer ring and the mounting of the chuck onto the inner ring ensure uniform pressure distribution across the periphery of the conditioning member. The fully sealed design protects the bearings and other components of the cardan joint from contamination by the slurry.

It is intended that the foregoing detailed description be regarded as illustrative, rather than limiting, and that it be understood that the following claims, including all equivalents, are intended to define the scope of this invention.

What is claimed is:

1. A CMP system comprising:

a movably mounted polishing member;

a wafer holder for holding a wafer relative to the polishing member;

a slurry dispenser for dispensing slurry onto the polishing member; and a conditioner having an arm, with at least two conditioning members being operably connected to the arm, the conditioning members being independently alignable along an axis substantially perpendicular to a surface of the conditioning member with respect to one another and configured to contact the polishing member.

2. The CMP system of claim 1, wherein the polishing member comprises a polishing belt and wherein the polishing member is linearly movable.

3. The CMP system of claim 1, wherein the polishing member comprises a rotary polisher.

4. The CMP system of claim 1, wherein each conditioning member comprises a conditioning disc which contacts the polishing member; and wherein the conditioning discs are gimbaled independent of one another.

5. The CMP system of claim 4, wherein the conditioning members comprise a main body with a contact surface, the contact surface being pre-shaped based on expected deformation of at least a portion of the polishing member during operation of the CMP apparatus.

6. The CMP system of claim 1, wherein the conditioning members are independently adjustable along a z-axis.

7. The CMP system of claim 1, wherein the conditioning members are independently adjustable based on amounts of pressure of the conditioning members on polishing member.

8. The CMP system of claim 7, wherein each conditioning member has associated with it a pressure sensor; and wherein the conditioning members are independently movable based on data from the pressure sensors.

9. The CMP system of claim 1, wherein the conditioner further comprises a second arm with at least one conditioning member.

10. The CMP system of claim 1, wherein the conditioning members rotate at different speeds.

11. The CMP system of claim 1, wherein the conditioning members rotate at a same speed.

12. The CMP system of claim 1, wherein the conditioning members rotate in different directions.

13. The CMP system of claim 1, wherein the conditioning members rotate in a same direction.

14. The CMP system of claim 1, wherein each conditioning member comprises a conditioning disc.

15. The CMP system of claim 1, wherein the conditioning members are configured to concurrently contact the polishing element.

16. The CMP system of claim 1, wherein pressure applied by each of the conditioning members on the polishing member is substantially uniform.

17. The CMP system of claim 1, wherein the conditioner consists of a single arm with the conditioning members operably connected to the single arm.

* * * * *